US005393152A

United States Patent [19]

Hattori et al.

[11] Patent Number: 5,393,152

[45] Date of Patent: Feb. 28, 1995

[54] PRINTING DEVICE HAVING OPENING AND SHUTTING MECHANISM

[75] Inventors: Yoshiteru Hattori, Bisai; Kazuya Asano; Susumu Misu, both of Nagoya, Japan

[73] Assignee: Brother Kogyo Kabushiki Kaisha, Nagoya, Japan

[21] Appl. No.: 108,531

[22] Filed: Aug. 19, 1993

[30] Foreign Application Priority Data

Aug. 26, 1992 [JP] Japan ..... 4-227210
Jan. 25, 1993 [JP] Japan ..... 5-009874

[51] Int. Cl.[6] ..... B41J 29/02

[52] U.S. Cl. ..... 400/691; 400/690.4; 400/356; 400/683; 400/692; 16/293; 312/319.2

[58] Field of Search ..... 400/88, 266.2, 355, 400/356, 357, 358, 616, 616.1, 680, 683, 684, 685, 690.4, 691, 692, 693, 701; 346/145, 134; 16/85, 231, 232, 280, 284, 293, 296, 306; 49/279; 312/319.2, 319.4, 327

[56] References Cited

U.S. PATENT DOCUMENTS

| | | | |
|---|---|---|---|
| 3,166,080 | 1/1965 | Neale | 131/241 |
| 4,193,164 | 3/1980 | Okayama | 16/141 |
| 4,424,606 | 1/1984 | Sorimachi | 16/296 X |
| 4,531,852 | 7/1985 | Madge et al. | 400/692 |
| 4,616,765 | 10/1986 | Katoh | 220/335 |
| 4,690,468 | 9/1987 | Lau | 16/293 X |
| 4,759,646 | 7/1988 | Piatt | 400/88 |
| 4,856,142 | 8/1989 | Fukunaga | 16/298 |
| 4,972,546 | 11/1990 | Lautenschaler, Jr. et al. | 16/294 X |
| 5,017,033 | 5/1991 | Hermann et al. | 400/693 |
| 5,028,913 | 7/1991 | Kitamura | 340/711 |
| 5,069,564 | 12/1991 | Kako et al. | 400/692 X |
| 5,129,750 | 7/1992 | Otsuki | 400/690.4 |
| 5,165,810 | 11/1992 | Bazzani | 400/691 X |
| 5,240,319 | 8/1993 | Koga | 312/319.2 |

FOREIGN PATENT DOCUMENTS

| | | | |
|---|---|---|---|
| 0448519A1 | 9/1991 | European Pat. Off. . | |
| 2743997 | 4/1979 | Germany | 16/294 |
| 2-744 | 1/1990 | Japan . | |
| 0106676 | 5/1991 | Japan | 400/692 |
| 4016373 | 1/1992 | Japan | 400/693 |

*Primary Examiner*—Edgar S. Burr
*Assistant Examiner*—Christopher A. Bennett
*Attorney, Agent, or Firm*—Oliff & Berridge

[57] ABSTRACT

A print head is supported on an upper frame of a printing device and a platen and a feeding device are supported on a lower frame. Further, a circuit substrate, a print head moving motor, and a feeding device driving motor are also supported on the upper frame. The upper and the lower frame are connected by a connection member around a rotating axis which is substantially orthogonal to the feeding direction of the print medium. The rotating axis is near a side of the platen in order to easily open and shut the upper frame. When a lock arm is released, the upper frame is pushed up by only a small angle through operation of a pre-open lever and is held in a pre-open position. When upper frame is further opened in an opening direction, the upper frame is held in a fully open position by the operation of an open lock lever. When in the fully open state, the exchange of print paper and/or the removal of the jammed paper can be done easily and safely.

18 Claims, 5 Drawing Sheets

PRINTING DEVICE HAVING OPENING AND SHUTTING MECHANISM

BACKGROUND OF THE INVENTION

1. Field of the Invention

The invention relates to a printer for printing data output by a device, such as a computer, on a print medium. More particularly, the invention relates to a printer capable of opening and shutting its upper frame relative to its lower frame in order to easily handle the print medium.

2. Description of Related Art

Conventionally known is a printer having a frame which can be opened and shut in order to exchange the print paper or remove jammed print paper.

In such a printer, an upper frame, on which a print head is arranged, is pivotably connected, at the side of the upper frame away from the print head, with a lower frame on which a platen and a feeding device are arranged. Under normal circumstances, that is, during printing, the upper frame is positioned on the lower frame by a lock mechanism such that the print head confronts with the platen. The print paper is intermittently fed between the print head and the platen by the feeding device and is printed by the print head.

If the lock mechanism is released, for exchanging the print paper and/or removing jammed paper, the upper frame is rotated around the rotating axis by the action of a spring that extends between the upper frame and the lower frame. As a result, the print head is separated from the platen with a big circular arc movement. Under such a condition, it is possible for the operator's hands to be inserted into the feeding device, between the platen of the lower frame and the rotating axis line of the upper frame, to remove the paper and/or to set a new paper in the feeding device. A printer so structured is disclosed in European Patent Application No. 448 519.

In the above described conventional printer, it is difficult to handle the paper at the time of exchanging the paper and removing the jammed paper because the operator must put his/her hands into the feeding device through the narrow gap between the upper frame in the opened condition and the platen. If the space around the feeding device is widened, the above problem will be solved. Such a solution, however, causes another problem in that it enlarges the whole printing device.

Further, it was dangerous to the operator, who exchanges the paper and/or removes the jammed paper, because the upper frame rotates to an open position by the action of the spring when the lock mechanism is released. Moreover, there is a further problem in that the opening and shutting mechanism, including the spring, needs to be quite large because of the considerable biasing power needed for opening the upper frame.

Further, in general printers, a motor to move the print head in the printing line direction and a motor to drive the feeding device were usually mounted to the side walls of the upper or the lower frame. Moreover, a circuit substrate, to control the print head and the motors, was usually arranged in a lower or rear portion of the upper and lower frame. Therefore, the printer was enlarged and the feeding path of the print paper was lengthened. This further deteriorated the operator's ability to handle the print paper.

SUMMARY OF THE INVENTION

An object of the invention is to provide a compact and superior printing device that permits the easy handling of the print paper.

The object of the invention is achieved by providing a printing device comprising an upper frame having a movable print head, a lower frame having a pair of side walls, a platen which confronts with the print head, a feeding mechanism which feeds a print medium between the platen and the print head, a connection member for rotatably connecting the upper frame with the lower frame around a rotation axis which is substantially orthogonal to a feeding direction of the print medium, a first elastic member for biasing the upper frame to move to a first position, the upper frame being held at the first position, with an opening angle smaller than the opening angle at an open position where the upper side of the feeding mechanism and the platen is completely opened, a lock member for holding the upper frame at a shut position where the upper frame covers the upper side of the feeding mechanism and the platen against a biasing power of the first elastic member, and a second elastic member for biasing the upper frame around the rotation axis in the direction of the open position and in the direction of the shut position. The upper frame further comprising thereon a circuit substrate having a circuit for controlling the print head, a moving motor for moving the print head in a printing line direction and a driving motor for driving the feeding mechanism.

In the printer of the invention thus structured, the print head confronts the platen provided on the lower frame when the upper frame is in a shut position. The print paper is intermittently fed between the print head and the platen by the feeding device and is printed by the print head. When the upper frame moves to an open position, the upper frame is rotated around an axis which is on the side of the lower frame where the platen is located and which is away from the feeding device. That is, the upper frame separates from the upper side of the feeding device, mounted in the lower frame, and moves, in opening, toward the side of the platen. Thereby, the feeding device is separated from the upper frame so that it is easy to remove the print paper from the feeding device and to set the print paper thereon.

Moreover, the circuit substrate and the two motors are arranged on the upper frame in parallel to the moving direction of the print head to make the printing device compact. As a result, the length of the feed path of the print paper can be shortened and the handling of the print paper can be improved.

When a lock member is released to move the upper frame to the open position, movement of the upper frame is suppressed by a first elastic member and the upper frame is opened to only a small angle. From the slight movement, the operator can determine whether the lock member is released. Next, the operator manually moves the upper frame to its open position where the upper frame is completely opened. When the upper frame approaches the open position, the spring power, according to the second elastic member, acts on the upper frame to hold the upper frame in the fully open position.

When the upper frame is returned to the shut position, after the print paper is exchanged and/or the jammed paper removal operation is completed, the upper frame is manually depressed with a force that is greater than the spring power of the second elastic member. Then, the upper frame is further manually depressed with a greater force than the spring power of the first elastic member so that the upper frame is completely shut and the lock member engages and locks the upper frame at the shut position. If the engagement of the lock member is imperfect, the operator can determine that the lock member has not engaged because the upper frame is opened slightly by the spring power of the first elastic member.

As mentioned above, according to the invention, the printing device can be constructed compactly, thereby shortening the feeding path of the print paper and the print paper can be handled easily. In addition, it is not dangerous to the operator to exchange the print paper and remove jammed paper because the upper frame does not open rapidly at one time when the lock member is released. Moreover, it is easy for the operator to put his/her hands into the feeding device to handle the print paper and other operations, all of which can be performed easily.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

A printing device according to the invention will be described with reference to the drawings.

Figure 1:
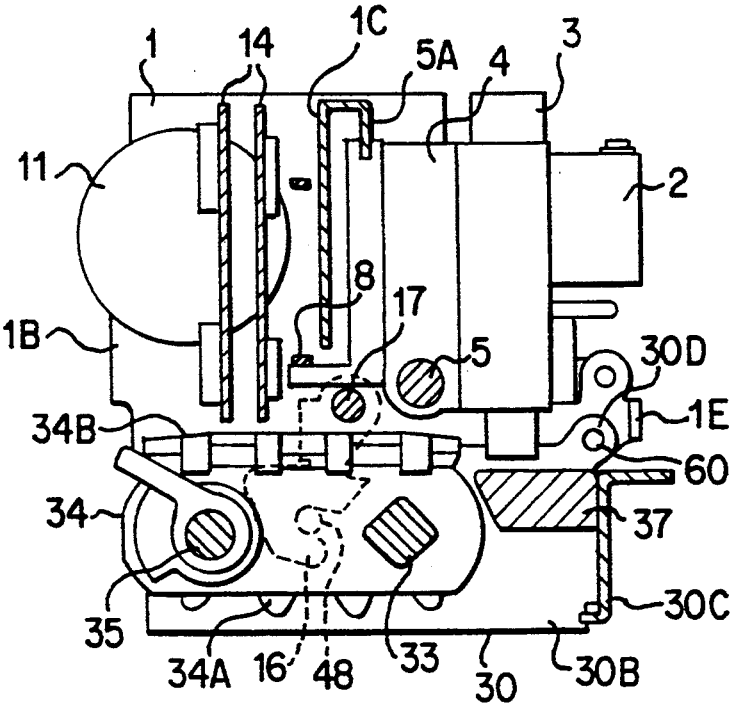
FIG. 1 is a sectional side elevation view of the printing device which embodies the invention.

The printing device of this embodiment comprises an upper frame 1 and a lower frame 30. As shown in FIG. 1, a print head 2 having its printing operation side extending downwardly is provided on the upper frame 1. A platen 37, that confronts the print head 2, and a pair of pin tractors 34,34, functioning as a feeding device, are provided on the lower frame 30.

Figure 2:
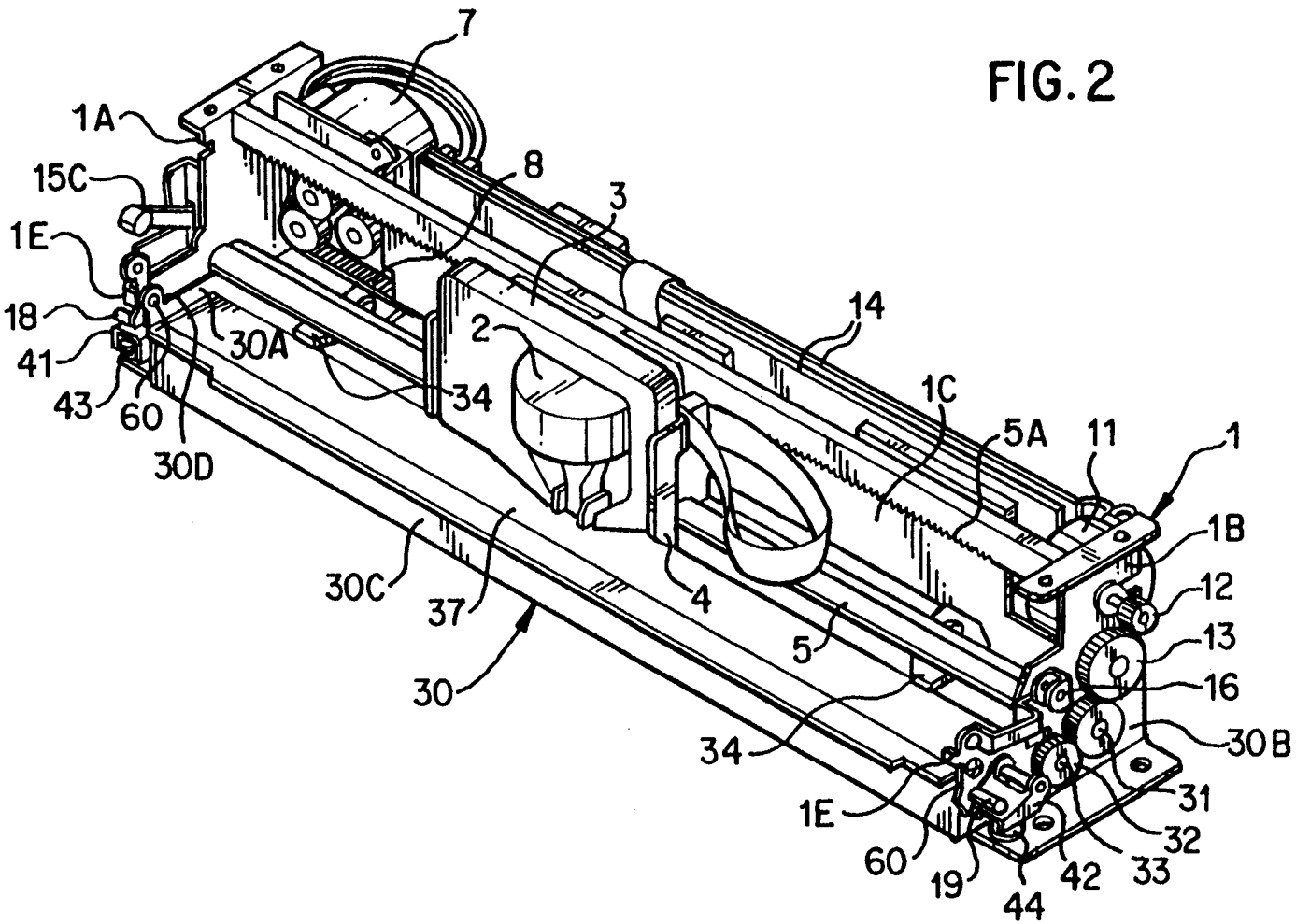
FIG. 2 is a perspective view of the printing device of FIG. 1.

The print head 2 is a well-known impact type print head having a plurality of wires. The wires are driven against the platen 37 by an electromagnet for each wire. The print head 2 is provided on a carriage 4 with an ink ribbon cassette 3, and is supported slidably in the printing line direction by a guide shaft 5 and a guide rail 5A. The guide rail 5A is provided on a center board 1C to be described below. The carriage 4 is driven, in the printing line direction, by a motor 7 through a belt 8 as shown in FIG. 2.

The pair of tractors 34,34 have rotation members, that is, a plurality of tractor pins 34A, on an outer surface of the tractor belt. The tractor pins 34A engage with sprocket holes provided on both sides of continuous print paper and are moved by the rotation of the drive shaft 33 to feed the continuous paper. Each pin tractor 34 has a paper suppression member which can be opened and shut, that is, a cover 34B, in order to maintain the engagement of the tractor pins 34A with the sprocket holes of the continuous print paper. Moreover, the pin tractors 34,34 are supported slidably in the printing line direction by the drive shaft 33 and a support shaft 35, so that it is possible to fix the pin tractors 34,34 in a position corresponding to the width of the continuous print paper being used. In the printing device of the invention, a feeding path of the continuous print paper is formed between the tractor belt of the pin tractor 34 and the cover 34B, on each side of the printer, and between the print head 2 and the platen 37. Thus, the continuous print paper is fed in a direction which is orthogonal to the printing line direction whenever a one line printing operation is performed by the print head 2.

The upper frame I has a rigid structure that includes right and left side frames 1A,1B and a center board 1C connecting the side frames 1A,1B. The side frames 1A,1B support the ends of the guide shaft 5 and the center board 1C supports two circuit substrates 14. The circuit substrates 14 have circuits that control the print head 2, the motor 7, and a motor 11 for driving the pin tractors 34,34. The circuit substrates 14 are positioned on an opposite side of the center board 1C, than the carriage 4, and extend in parallel to the moving direction of the carriage 4 and in a vertical direction as shown in FIG. 2. The two motors 7,11 are provided, one at each end of the circuit substrates 14, and they are mounted on the center board 1C. One of the motors is near the side frame 1A and the other motor is near the side frame 1B. Thereby, the weight of the printing device from side to side is substantially balanced to aid in carrying.

The lower frame 30 has a U-shaped structure, that is it includes right and left side frames 30A,30B and a board 30C which connects side frames 30A,30B at their edges. A platen 37 contacts the inside of the board 30C and is fixed between the side frames 30A,30B. Both ends of the drive shaft 33 and the support shaft 35 of the pin tractor 34 are supported by the side frames 30A,30B. The pin tractors 34,34, as shown in FIG. 1, are positioned so that one side extends slightly under an edge of the platen 37. As a result, one side of the covers 34B,34B is positioned in the vicinity of the upper side of the platen 37. Thus, the covers 34B,34B suppress separation of the print paper from the platen 37.

The upper frame 1 and the lower frame 30 are pivotably connected around a pair of stepped screws 60 forming a connecting member. As shown in FIG. 1, the lower frame 30 has a pair of arms 30D which stand up from the right and left side frames 30A,30B near the edge of the platen 37 that is away from the pin tractor 34. Each stepped screw 60 penetrates through an arm 30D and a side frame 1A,1B of the upper frame 1 which is mounted to a respective one of the stepped screws 60. As a result, the upper frame 1 can be opened from and shut to the lower frame 30 around an axis line extending between the stepped screws 60 which is orthogonal to the paper feeding direction (that is, the axis line is parallel to the printing line direction). The pin tractors 34,34, the platen 37 and the axis line extending between the stepped screws 60 are arranged in order along the paper feeding direction of the print paper. The pin tractors 34,34 are arranged upstream, in the paper feeding direction of the axis line.

When the upper frame is in the shut position, the upper side of the platen 37 and the pin tractors 34,34 are covered as shown in FIG. 1. In this shut position, the print head 2 confronts the platen 37 and the circuit substrates 14 and the two motors 7 and 11 are located substantially above the pin tractors 34,34.

Figure 6:
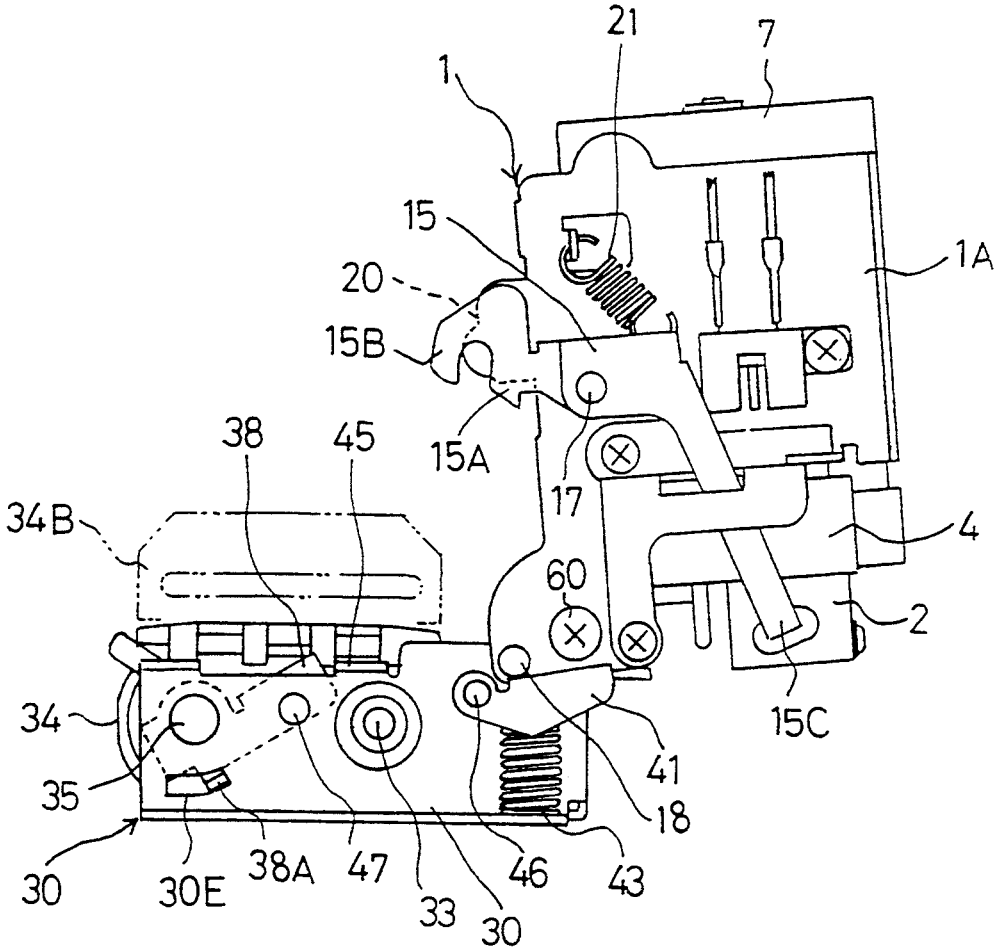
FIG. 6 is a side elevation view of the printing device of FIG. 1 whose upper frame is in an open position.

When opened, the upper frame 1 separates from the upper side of the pin tractors 34,34, as shown in FIG. 6, and stands up at the side of the platen 37. In this open position, a stopper 1E extended as a curved portion from each side frame 1A,1B comes in contact with the board 30C of the lower frame 30 to restrict the rotating angle of the upper frame 1.

A lock member to hold the upper frame 1 in the shut position is constructed from a pair of lock arms 15,16 and a pair of bent portions 45,45. A lock arm 15,16 is provided on the outer side of each side frame 1A,1B of the upper frame 1. One of the lock arms 15,16 is fixed to each end of a shaft 17 which extends through the upper frame 1 in a direction parallel to the printing line. Therefore, the lock arms 15,16 can be rotated together. The shaft 17 is pivotally mounted in both side frames 1A,1B. An operation lever 15C extends only from arm 15 to enable manual operation of the arm 15.

A bent portion 45 is provided on each side frame 30A,30B of the lower frame 30 paired with a lock arm 15,16. A guide pin 47 is further provided under each bent portion 45. Each lock arm 15,16 has a hook portion 15A,16A which engages the underside of the bent portion 45. Each lock arm 15,16 also has a U-shaped portion 15B,16B which engages the appropriate guide pin 47. Moreover, each lock arm 15,16 is always biased by a spring 21 in the direction so as to engage the bent portion 45.

Figure 7:
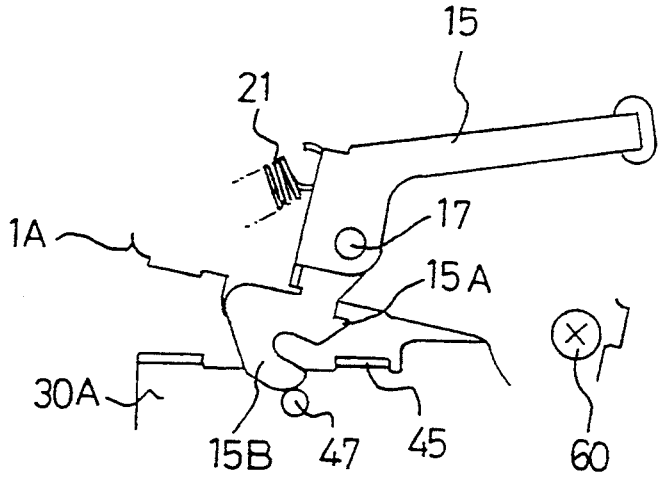
FIG. 7 is a partial side elevation view of the printing device of FIG. 4.

When the upper frame 1 is being shut, as shown in FIG. 7, a circular arc portion, formed under the tip of the U-shaped portion 15B,16B, contacts the guide pin 47 before the hook portion 15A,16A engages the bent portion 45. In the process, the arm 15,16 is rotated against the force of the spring 21 by a cam action of the circular arc portion. As a result, the hook portion 15A,16A is guided to a position to be engaged with the bent portion 45. Therefore, abrasion between the hook portion 15A,16A and the bent portion 45 can be kept to a minimum. When the hook portion 15A,16A is engaged with the bent portion 45, the guide pin 47 is slightly separated from the inside surface of the U-shaped portion 15B,16B (separation not shown in FIG. 3).

Figure 3:
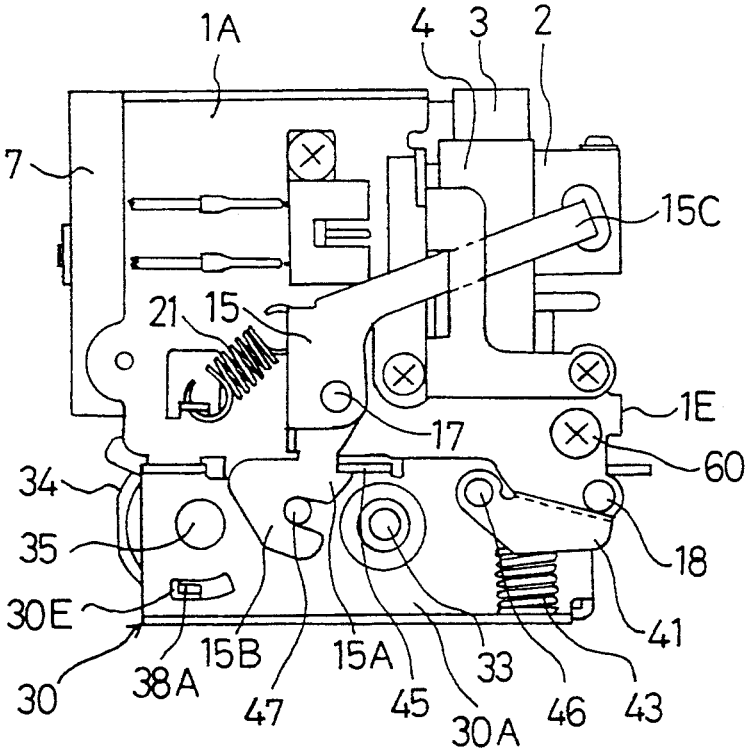
FIG. 3 is a side elevation view of the printing device of FIG. 1 whose upper frame is in a shut position.
Figure 4:
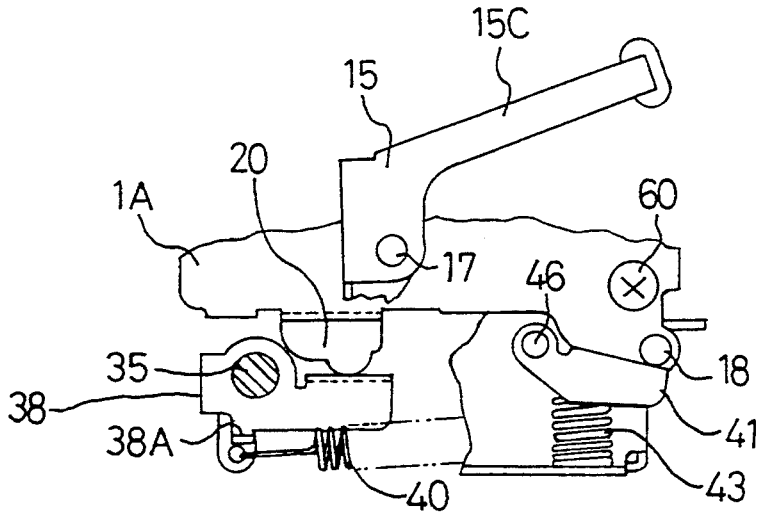
FIG. 4 is a partial side elevation view of the printing device of FIG. 3.
Figure 5:
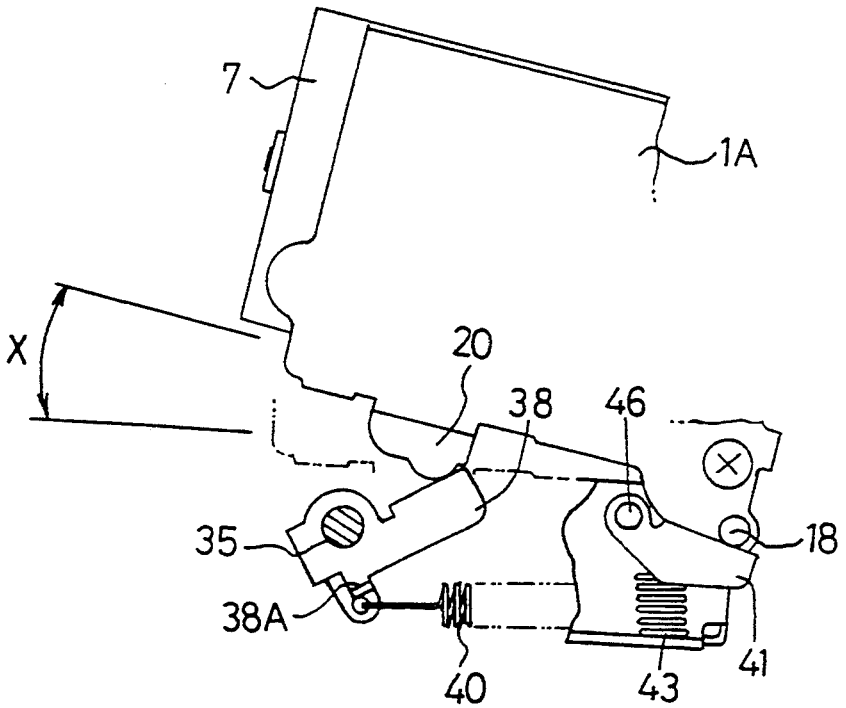
FIG. 5 is a partial side elevation view of the printing device whose upper frame is slightly opened.

A first elastic biasing member, which separates the upper frame 1 from the lower frame 30 by a first angle, the first angle being smaller than the angle in the fully open position, comprises a pre-open lever 38 and a spring 40 as shown in FIGS. 4 and 5. The pre-open lever 38 is rotatably supported by the support shaft 35 as it extends between the side frame 30A of the lower frame 30 and the pin tractor 34 on the side of the side frame 30A. A projection 20 which projects toward the lever 38 is installed in the side frame 1A of the upper frame 1. The free edge of the lever 38 is biased by the spring 40 in the direction where the projection 20 is pushed up. Further, a projection 38A, provided on the lever 38, is inserted into a window 30E of the side frame 30A, as shown in FIG. 3, so that the moving range of the lever 38 is limited to the length of the window 30E.

A second elastic member which holds the upper frame 1 in the open position comprises pins 18,19, open lock levers 41,42, and springs 43,44. A one of the pins 18,19 is provided on each side frame 1A,1B of the upper frame 1 and extends almost in parallel to the direction of a center axis line extending between the stepped screws 60,60. Moreover, the pair of open lock levers 41,42 are rotatably supported by a shaft 46 extending from each side frame 30A,30B of the lower frame 30, respectively parallel to the pins 18,19. Each lock lever 41,42 is pressed by the associated spring 43,44 against the associated pins 18,19 so that pins 18,19 are pushed up. The pins 18,19 move back and forth of the center axis line extending between the stepped screws 60,60 according to the rotation of the upper frame 1. FIGS. 3 and 6 show the positional relationship between the pin 18 and the stepped screw 60 with the upper frame closed and open, respectively. During such the movement, the pins 18,19 contact with and slide on the respective levers 41,42, receiving the above mentioned force of the associated spring 43,44.

The pin tractor 34 is driven by the motor 11 through the gear unit shown in FIG. 2. The motor 11 and gears 12 and 13, driven by the motor 11, are supported to the side frame 1B of the upper frame 1. Gears 31 and 32 which mutually engage are supported on the side frame 30B of the lower frame 30 with the gear 32 fixed to the drive shaft 33 of the pin tractor 34. The gear 13 of the upper frame 1 engages the gear 31 of the lower frame 30 when the upper frame 1 is in the shut position. The rotation of the motor 11 is thereby transmitted to the pin tractor 34. When the upper frame 1 moves to the open position, the engagement between gears 13 and 31 is released.

Operation of the printing device of this embodiment will now be explained.

When the upper frame 1 is in a shut position, that is, in a condition in which printing can take place, the pre-open lever 38 contacts the projection 20, as shown in FIG. 4, with the force of the spring 40 attempting to press the upper frame 1 to open, that is, in a direction where the projection 20 is pushed up. However, the lock arms 15,16 are engaged with the bent portions 45, as shown in FIG. 3, so that the upper frame 1 is held in the shut position. Under such a condition, the print head 2 confronts the platen 37 with a fine space therebetween, and can print an image on the continuous paper that is fed between the print head 2 and the platen 37 by the pin tractors 34,34.

The lock arms 15,16 separate from the bent portions 45,45 and the guide pins 47,47 when the lock arms 15,16 are rotated in a clockwise direction by the operation of the lever 15C of the lock arm 15 against the force of the spring 21. Thus, as shown in FIG. 5, the pre-open lever 38 pushes the upper frame 1 upwardly by the force of the spring 40 until an opening angle X is reached. The opening angle X of the upper frame 1, shown in FIG. 5, is the angle where the stopper 38A of the pre-open lever 38 contacts the edge of the window 30E, as shown in FIG. 6, and it is smaller than the opening angle of the open position which the upper frame is completely opened. Until the upper frame reaches the pre-open position, defined by the opening angle X, the open lock levers 41,42 push the pins 18,19 upwardly by force of the springs 43,44 to press the upper frame 1 in a counter clockwise direction, that is in the direction of the shut position. However, the force of the springs 43,44 of the open lock levers 41,42 is smaller than the force of the spring 40 of the pre-open lever 38. As a result, the upper frame 1 is moved in the opening direction and is held at the pre-open position. In such a position, the operator can recognize that the lock member of the upper frame has been released.

The operator then manually lifts the upper frame 1, rotating it around the center axis of the stepped screws 60, to move the upper frame 1 to the open position. As the upper frame 1 rotates around the stepped screws 60, the pins 18,19 slide on their respective open lock lever 41,42, and pass just under the center axis of the stepped screws 60 to reach an interior position of the lower frame 30. As a result, as shown in FIG. 6, the open lock levers 41,42 press their respective pin 18,19 in a clockwise direction, that is, they press the upper frame 1 in the open direction. The rotation of the upper frame 1 stops when the stopper 1E comes into contact with the lower frame 30.

As mentioned above, a small spring whose stroke is short can be used as the spring 40 for the pre-open lever 38 because the spring 40 is only for opening the upper frame 1 for the small opening angle X. Moreover, the springs 43,44 of the open lock levers 41,42 also can be a small spring because the springs 43,44 are not used in a first half of the opening operation of the upper frame, rather they are only used for opening near the open position. Therefore, the spring mechanism of the present embodiment has the advantage that it can be miniaturized as well as providing an opening movement of the upper frame which is not dangerous to the operator.

When the upper frame 1 is in the open position, as shown in FIG. 6, the space above the pin tractors 34,34 is completely opened, so that the covers 34B,34B of the pin tractors 34,34 can be opened easily. Therefore, the print paper can be easily removed and a new print paper can be easily set. Moreover, when completely open, the upper frame 1 stands up at the side of the platen 37 that is away from the pin tractors 34,34. Thus, it is easy to manipulate the pin tractors 34,34 and the print paper by hand as pin tractors 34,34 are located away from the platen 37 and the upper frame 1.

To return the upper frame 1 to the shut position, the operator manually presses the upper frame 1 against the biasing force of the open lock levers 41,42. According to the above operation, when the pins 18,19 pass just under the center axis of the stepped screws 60,60 toward the outside of the lower frame 30, the upper frame 1 falls naturally to the position of the opening angle X, shown in FIG. 5. Then, the operator manually presses the upper frame 1 against the biasing power of the pre-open lever 38. At that time, the circular arc portions formed on the tip of the U-shaped portions 15B,16B of the lock arms 15,16 come into contact with the appropriate guide pins 47,47 and the lock arms 15,16 are rotated in the clockwise direction by the cam action of the circular arc portion. When the lock arms 15 and 16 engage the bent portions 45,45, by the action of the spring 21, the upper frame 1 is fixed to the lower frame 30 at the shut position.

If the engagement of the arms 15,16 and the bent portions 45,45 is imperfect, the upper frame 1 is returned by the action of the pre-open lever 38 to the slightly open position so the operator can recognize the engagement is imperfect.

It is to be understood that the invention is not restricted to the particular forms shown in the foregoing embodiment. Various modifications and alterations can be added thereto without departing from the scope and spirit of the invention encompassed by the appended claims.

The invention can be applied to a printer having a thermal type print head. Further, a pair of paper feed rollers can be used instead of the pin tractor as a paper feeding device.

What is claimed is:

1. A printing device, comprising:

an upper frame having a movable print head;

a lower frame having a platen which confronts said print head and a feeding mechanism which feeds a print medium between said platen and said print head;

a biasing member;

a connecting member which connects said upper frame and said lower frame at one side of said platen, said feeding mechanism and said biasing member on an opposite side of the platen than said connecting member, said connecting member rotatably connecting said upper frame and lower frame around a rotating axis orthogonal to a feeding direction of the print medium, wherein said upper frame has a shut position where said upper frame covers said platen and said feeding mechanism and a fully open position where said upper frame is away from said feeding mechanism and is positioned to said one side of said platen, said upper frame being urged to a first open position by said biasing member when said upper frame is not properly shut.

2. The printing device as claimed in claim 1, wherein said feeding mechanism, said platen and said connecting member are arranged in sequence along the feeding direction of the print medium, said feeding mechanism being most upstream in the feeding direction of the print medium.

3. The printing device as claimed in claim 1, wherein said feeding mechanism comprises a rotation member having a plurality of pins on its outer peripheral surface and a holding member which maintains the engagement of the pin with the print medium, said holding member capable of being opened and shut relative to said rotation member.

4. The printing device as claimed in claim 3, wherein one end of said holding member is adjacent to the upper side of said platen.

5. The printing device as claimed in claim 1, wherein said upper frame includes a circuit substrate which controls said print head, said circuit substrate supported on said upper frame substantially in parallel with the moving direction of said print head.

6. The printing device as claimed in claim 5, wherein said circuit substrate is located above said feeding mechanism when said upper frame is in the shut position.

7. The printing device as claimed in claim 6, wherein said upper frame includes a first motor which drives movement of said print head in a printing line direction and a second motor which drives said feeding mechanism, a one of said two motors being located on each side of said circuit substrate.

8. A printing device, comprising:

an upper frame having a movable print head;

a lower frame having a platen for confronting with said print head and a feeding mechanism which feeds a print medium between said platen and said print head;

connection means for connecting said upper frame with said lower frame rotatably around an axis which is substantially orthogonal to a feeding direction of the print medium; and first holding means for holding said upper frame at a shut position where said upper frame covers the upper side of said feeding mechanism and said platen and at an open position where the upper side of said feeding mechanism and said platen is fully exposed; and second holding means for holding said upper frame at a partially open position between said shut position and said open position, wherein said upper frame further comprises a circuit substrate having a circuit for controlling said print head, a moving motor for moving said print head in a printing line direction and a driving motor for driving said feeding mechanism.

9. The printing device as claimed in claim 8, wherein said circuit substrate, said moving motor and said driving motor are arranged on said upper frame substantially in parallel to the moving direction of said print head, and said moving motor and said driving motor are located at opposite ends of said circuit substrate.

10. The printing device as claimed in claim 9, wherein said circuit substrate, said moving motor and said driving motor are located above the feeding mechanism of said lower frame when said upper frame is in a shut position.

11. A printing device, comprising:

an upper frame having a movable print head, a first side and a second side;

a lower frame having a pair of side walls, a platen which confronts said print head, and a feeding mechanism which feeds a print medium between said platen and said print head;

connection means at said first side of said upper frame for connecting said upper frame with said lower frame rotatably around a rotation axis which is substantially orthogonal to a feeding direction of the print medium;

first elastic means proximate said second side of said upper frame for biasing said upper frame to move to a first open position, said upper frame being held at the first open position which has an opening angle that is smaller than an opening angle when said upper frame is at a fully open position where an upper side of both said feeding mechanism and said platen are completely exposed;

lock means for holding said upper frame at a shut position where said upper frame covers the upper side of both said feeding mechanism and said platen against a biasing power of said first elastic means; and second elastic means proximate said first side of said upper frame for biasing said upper frame around the rotation axis in the direction of the fully open position and in the direction of the shut position, wherein said first elastic means, said second elastic means and said connection means are successively located downstream of one another in the feeding direction of the print medium.

12. The printing device as claimed in claim 11, wherein the rotation axis of said upper frame is downstream of the platen in the feeding direction of the print medium.

13. The printing device as claimed in claim 12, wherein said first elastic means includes a first lever rotatably mounted to said lower frame and which contacts with said upper frame at the upstream side of the platen with respect to the feeding direction, and a spring connected between said first lever and said lower frame to bias said first lever to rotate in the direction to push up said upper frame.

14. The printing device as claimed in claim 13, wherein said first lever is located between one side wall of said lower frame and said feeding mechanism, and said upper frame includes a projection extending from said upper frame to contact with said first lever.

15. The printing device as claimed in claim 14, wherein said first lever includes a stopper member for stopping the movement of said upper frame moved by said first elastic means at the first position.

16. The printing device as claimed in claim 12, wherein said second elastic means biases said upper frame to move in the direction of the shut position when said upper frame is in the first open position, and to move and hold to said upper frame in the fully open position when said upper frame is further opened exceeding the first open position.

17. The printing device as claimed in claim 16, wherein said second elastic means comprises:

a second lever rotatably mounted to said lower frame;

a member projecting from a side of said upper frame; and a spring mounted between said second lever and said lower frame to bias said second lever, wherein said second lever comes into contact with said member which moves between positions downstream and upstream of the rotation axis of said upper frame according to the rotation of said upper frame from the first open position to the fully open position.

18. The printing device as claimed in claim 17, wherein said member projects parallel to the rotation axis and comes into contact with an upper surface of said second lever, said second lever being rotatable around an axis which is parallel to said member.

* * * * *